US006612082B2

(12) United States Patent
Schimmelpfennig et al.

(10) Patent No.: US 6,612,082 B2
(45) Date of Patent: Sep. 2, 2003

(54) CONCRETE REINFORCING BAR PROTECTIVE COVER

(75) Inventors: Jerry D. Schimmelpfennig, Mount Pleasant, IA (US); Randy L. Sperry, Burlington, IA (US)

(73) Assignee: Lomont Molding, Inc., Mt. Pleasant, IA (US)

( * ) Notice: Subject to any disclaimer, the term of this patent is extended or adjusted under 35 U.S.C. 154(b) by 0 days.

(21) Appl. No.: 09/911,660

(22) Filed: Jul. 24, 2001

(65) Prior Publication Data

US 2002/0108321 A1 Aug. 15, 2002

Related U.S. Application Data

(63) Continuation-in-part of application No. 29/137,063, filed on Feb. 12, 2001.

(51) Int. Cl.[7] ..... E04H 12/00

(52) U.S. Cl. ..... 52/300; 52/301; 248/523; 248/553; 16/121; 74/553

(58) Field of Search ..... 52/301, 300, 289, 52/689; 248/523, 188.9, 553, 558; 16/121; 74/553, 558

(56) References Cited

U.S. PATENT DOCUMENTS

| | | | | |
|---|---|---|---|---|
| 4,623,756 A | * | 11/1986 | Wilson, Jr. | 174/158 F |
| 5,600,927 A | * | 2/1997 | Kennon | 52/301 |
| 5,729,941 A | * | 3/1998 | Kassardjian et al. | 248/523 |
| 5,884,443 A | | 3/1999 | Schimmelpfennig et al. | |
| 5,943,836 A | * | 8/1999 | Kassardjian | 248/523 |
| 5,946,871 A | * | 9/1999 | Kassardjian et al. | 138/96 R |
| D416,631 S | | 11/1999 | Schimmelpfennig et al. | |
| 6,021,614 A | * | 2/2000 | Krieger | 52/301 |
| D460,571 S | * | 7/2002 | Schimmelpfennig | D25/135 |

* cited by examiner

*Primary Examiner*—Carl D. Friedman
*Assistant Examiner*—Chi Q. Nguyen

(57) ABSTRACT

A protective cover for covering the end of a reinforcing bar has a cylindrical tube having an open end and an upper end. A cap is on the upper end of the tube, and an inverted fristo-conical surface is provided in the upper end of the tube to cause the reinforcing bar to orient itself vertically upon impact by a falling body. The protective cover also has strengthening ribs both above and below the canopy to prevent its inadvertent collapse. The ribs below the canopy are further strengthened against lateral deflection by a circular wall which extends downwardly from the canopy and intersects each of the ribs at their substantial mid section.

16 Claims, 7 Drawing Sheets

CONCRETE REINFORCING BAR PROTECTIVE COVER

CROSS REFERENCE TO RELATED APPLICATION

This application is a Continuation-in-part of Design patent application Ser. No. 29/137,063 filed Feb. 12, 2001.

BACKGROUND OF THE INVENTION

During construction of buildings, bridges and the like, it is common to have the ends of steel reinforcing bars protruding from walls, columns and the like during various stages of the construction. The protruding ends of the reinforcing bars present a hazard to workmen who might fall on the bars.

Certain safety regulations in most locations now require that caps or covers be placed on the ends of the protruding bars so as to protect workers that might fall onto the bars. Occupational Safety and Health Standards Boards (OSHA) have established certain standards for such caps to insure that they are of sufficient strength and durability that the cap will maintain its integrity even under all reasonable conditions that a person might fall on the protruding bars. A typical standard would require that the caps be able to withstand the impact of a 250 pound weight dropped from a height of 10 feet without the protruding rod penetrating the cap. Minimum sizes of the cap are also established so that the top of the cap is substantially greater than the diameter of the bar on which it is mounted.

A typical existing cap for these purposes is illustrated in U.S. Pat. No. 5,568,708.

Some existing caps have a steel plate incorporated within a molded plastic cap to add strength thereto and to further resist puncturing of the cap when a load is imposed on the top of a rod. Such caps are relatively heavy for handling in both quantities, and the shipping costs thereof are obviously high. The incorporation of a metal plate in the plastic molding adds to the expense of manufacture through both cost of material and assembly expense.

In addition, certain prior art structures, such as that shown in U.S. Pat. No. 5,884,443, do not have structure which tends to allow the cover to center itself on the reinforcing bar. Reinforcing bars ("re-bar") are mandated by OSHA to have safety caps therefore on construction sites to protect workers from impalement in the event they accidentally fall upon a vertically positioned rebar.

Safety caps are manufactured with a cylindrical shaped re-bar pocket with compliant internal fins to hold the cap in an upright, vertical orientation. The re-bar pocket is sized to fit on larger diameter re-bars and the fins assist in orienting the caps when they are installed on smaller diameter re-bar. The fins also direct the re-bar tip toward the center of the cap where it is more capable of withstanding impact loading without the re-bar penetrating the caps dome.

It is common practice for contractors to reuse caps and after repeated re-use the orientation fins can become damaged or removed altogether. In this condition, caps can tip off vertically and thereby place the end of smaller diameter rebar at the outer edge of the pocket where the cap is most vulnerable to penetration.

A principal object of this invention is to provide a reinforcing bar cover that will withstand existing drop test without having a steel plate inserted therein.

A further object of this invention is to provide a protective cover for reinforcing bars that is relatively light in weight, and efficiently and economically capable of being manufactured.

A still further object of this invention is to provide a protection cover for reinforcing bars to ensure that the tip of the bar is oriented in the center of the bar pocket, and to maximize the opportunity for the cap to orient vertically upon impact by a falling body.

BRIEF SUMMARY OF THE INVENTION

A protective cover for covering the end of a reinforcing bar has a cylindrical tube having an open end and an upper end. A cap is on the upper end of the tube, and an inverted frusto-conical surface is provided in the upper end of the tube to cause the reinforcing bar to orient itself vertically upon impact by a falling body.

The protective cover also has strengthening ribs both above and below the canopy to prevent its inadvertent collapse. The ribs below the canopy are further strengthened against lateral deflection by a circular wall which extends downwardly from the canopy and intersects each of the ribs at their substantial mid section.

DESCRIPTION OF THE PREFERRED EMBODIMENT

Figure 1:
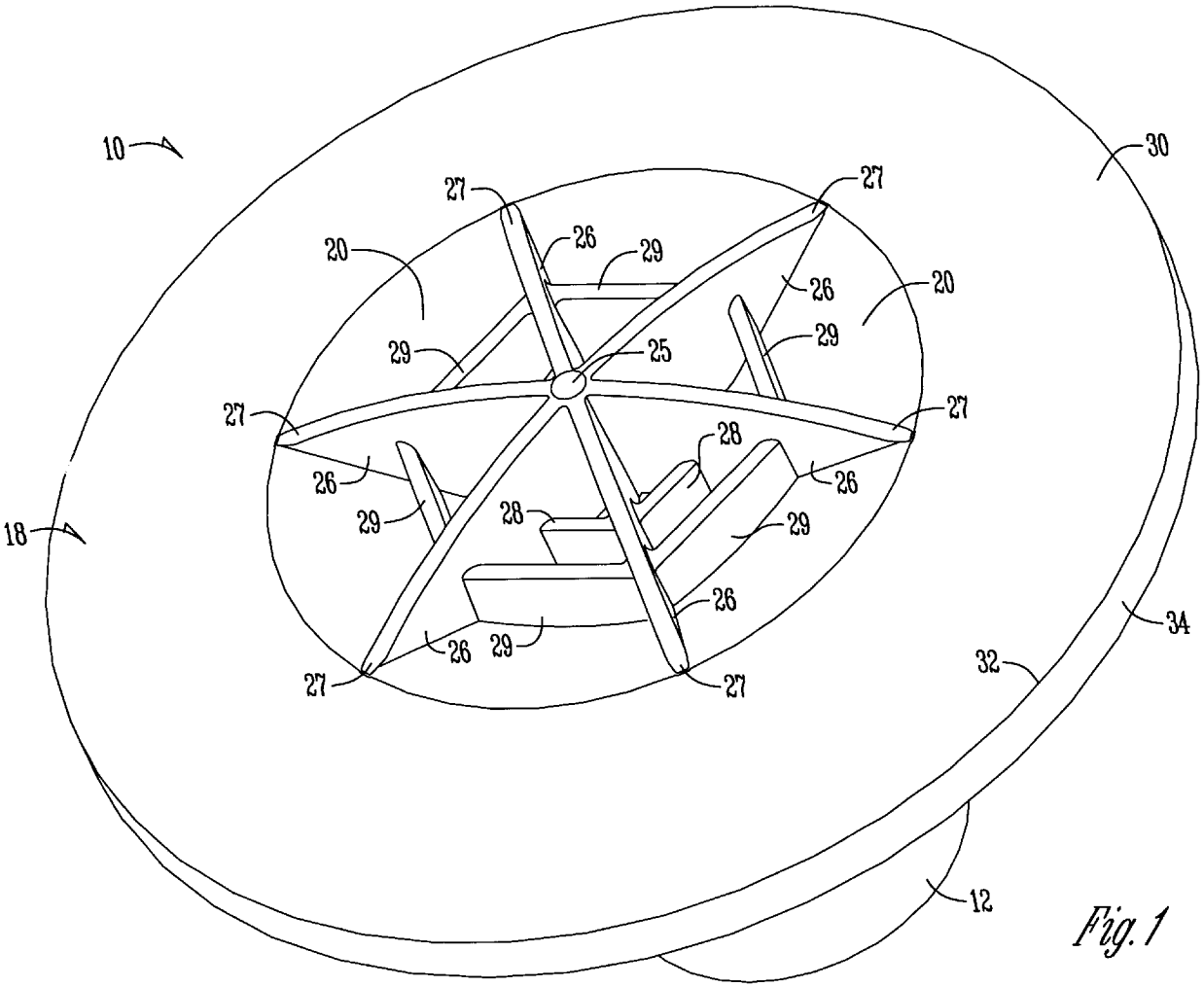
FIG. 1 is a top perspective view of the device of this invention.

The cover 10 is comprised of a vertical hollow tube 12 which has an upper end 14 and an open lower end 16. A plurality of spaced vertically disposed friction bars 17 are formed on the inner surface of tube 12 to frictionally engage the end of a reinforcing bar which is inserted within the tube.

A cap 18 is positioned on the upper end 14 of tube 12. A conically shaped wall 20 extends upwardly and outwardly from the upper end 14 of the tube. Wall 20 has a circular upper edge 21. A bottom 22 closes the upper end 14 of tube 12, and a center post 24 extends upwardly from the center of bottom 22. The upper end 25 of post 24 extends above the level of the upper edge 21 of wall 20.

A plurality of flat ribs 26 with an arcuate upper edge 27 extend between the post 24 and the wall 20. The arcuate upper edge 27 of the ribs extends from the upper end 25 of post 24 downwardly to the upper edge 21 of wall 20. Secondary spaced and parallel ribs 28 and 29 extend between adjacent ribs 26 adjacent the bottom of post 24 to further stiffen the ribs 26.

A canopy 30 extends from the upper edge 21 of wall 20 and extends in a curved direction downwardly and outwardly away from the upper edge 21 of the wall 20. The canopy 30 has a circular perimeter edge 32. A circular flange 34 extends uniformly downwardly from the perimeter edge 30.

Figure 3:
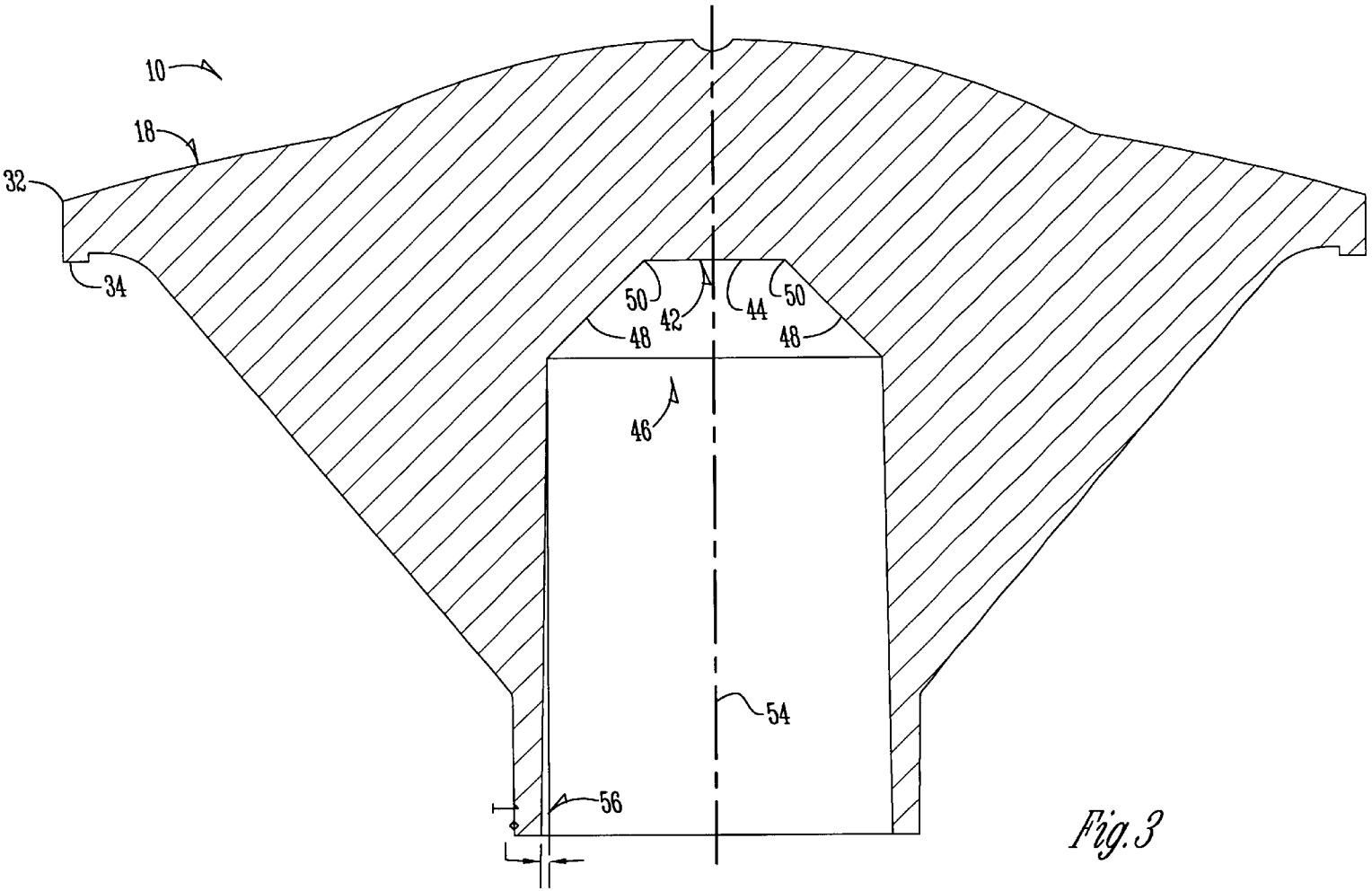
FIG. 3 is a sectional view taken on line 3—3 of FIG. 5.
Figure 3A:
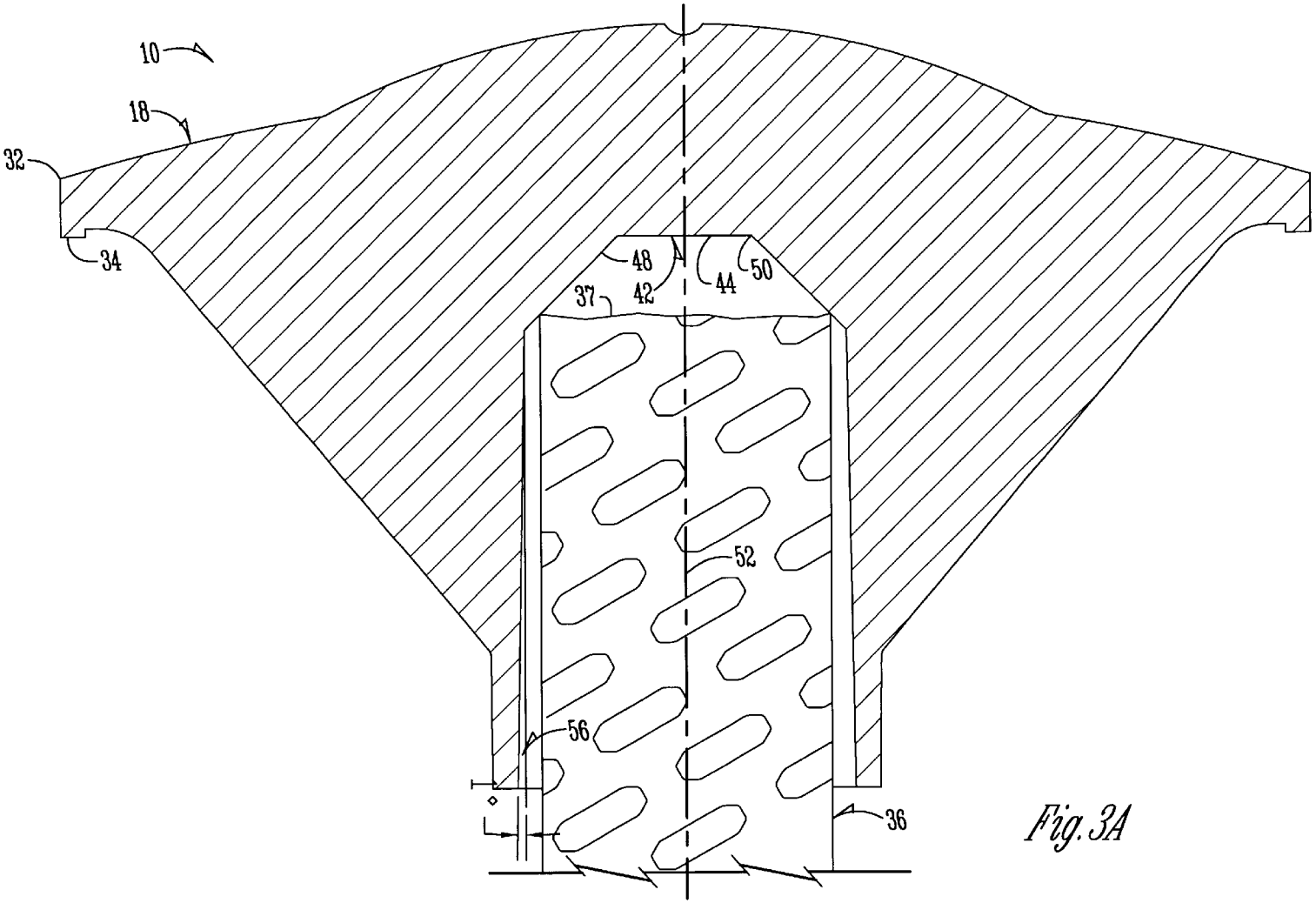
FIG. 3A is a sectional view similar to that of FIG. 3 but shows a reinforcing bar inserted within the cover.
Figure 4:
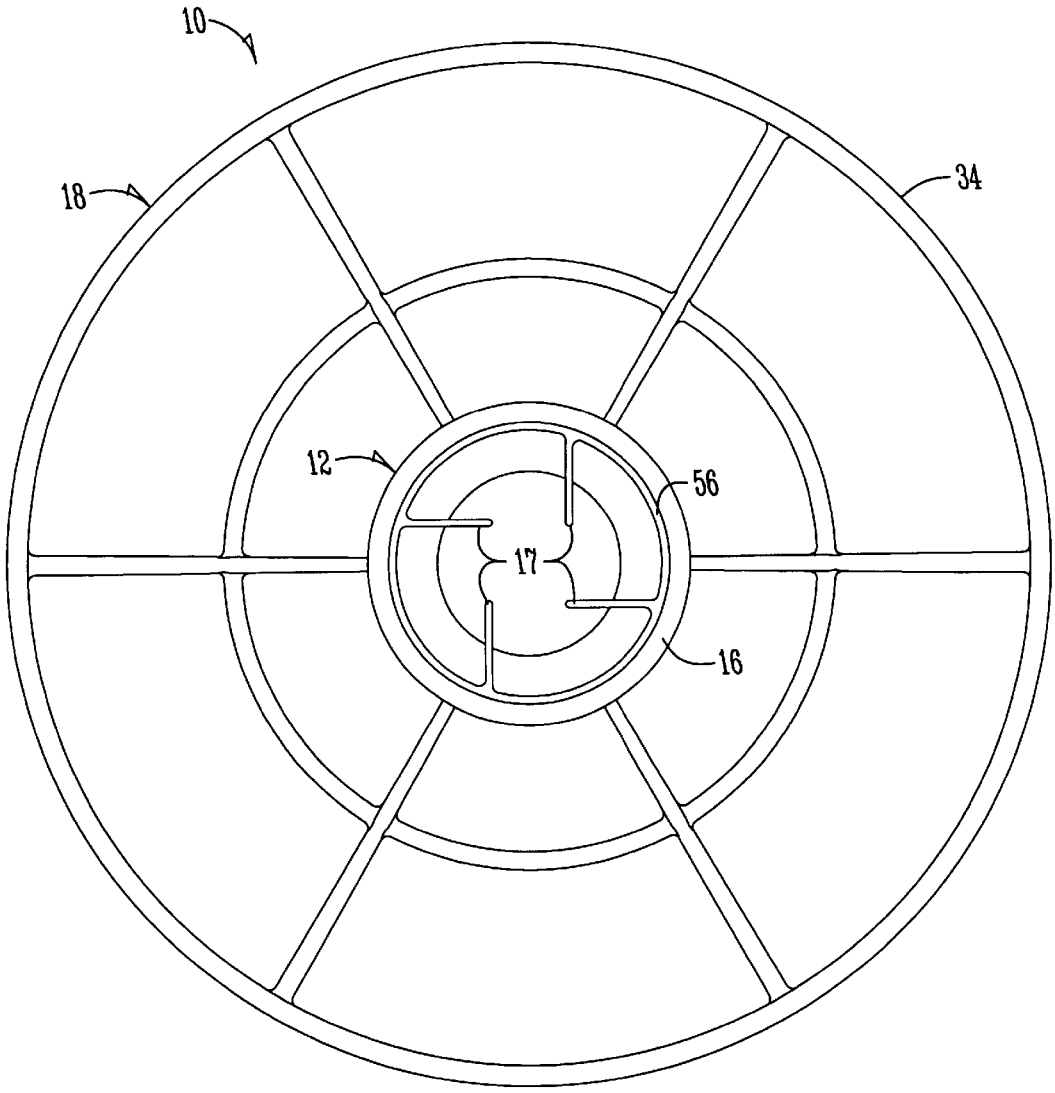
FIG. 4 is a bottom plan view thereof.
Figure 5:
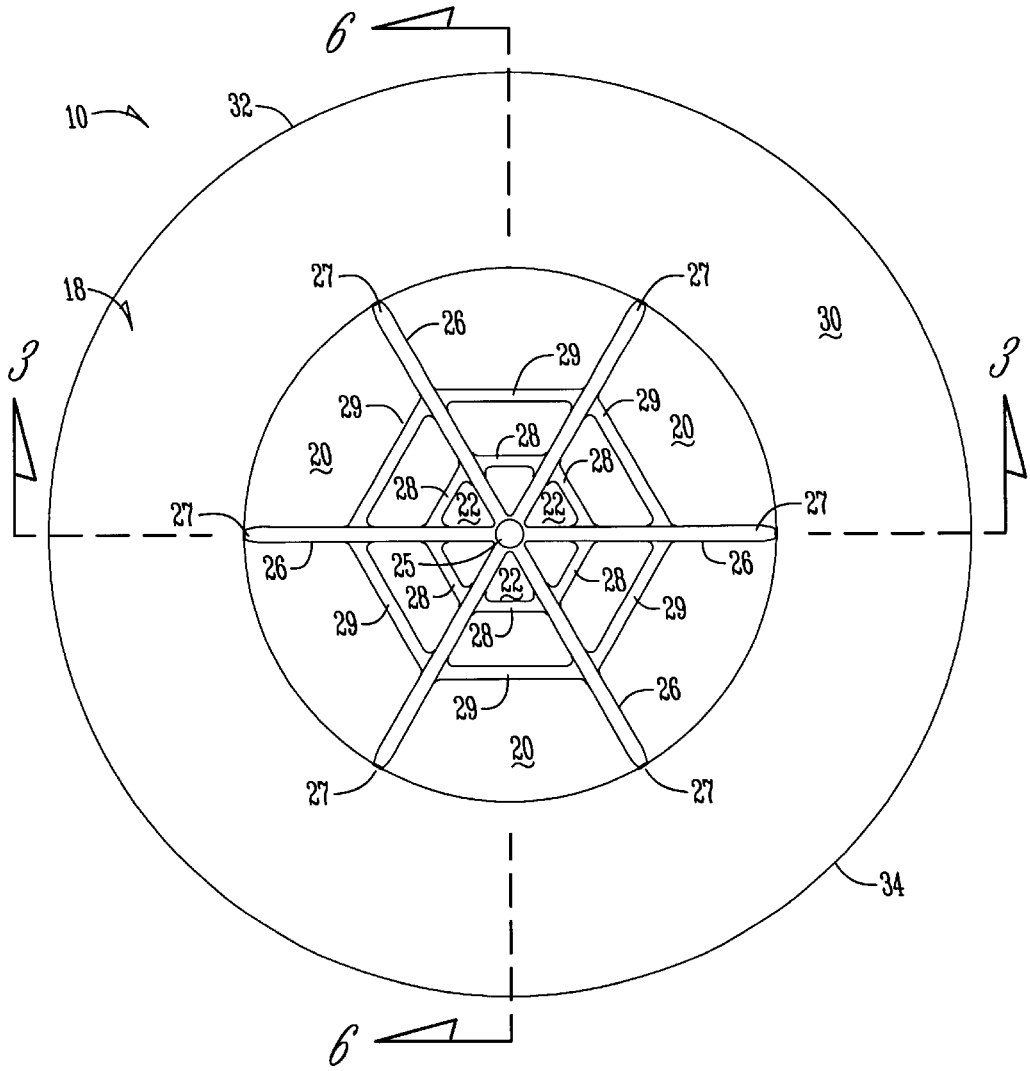
FIG. 5 is a top plan view thereof.

A reinforcing bar 36 is shown in FIG. 3A penetrating the hollow tube 12. Bar 36 has an upper end 37.

Figure 2:
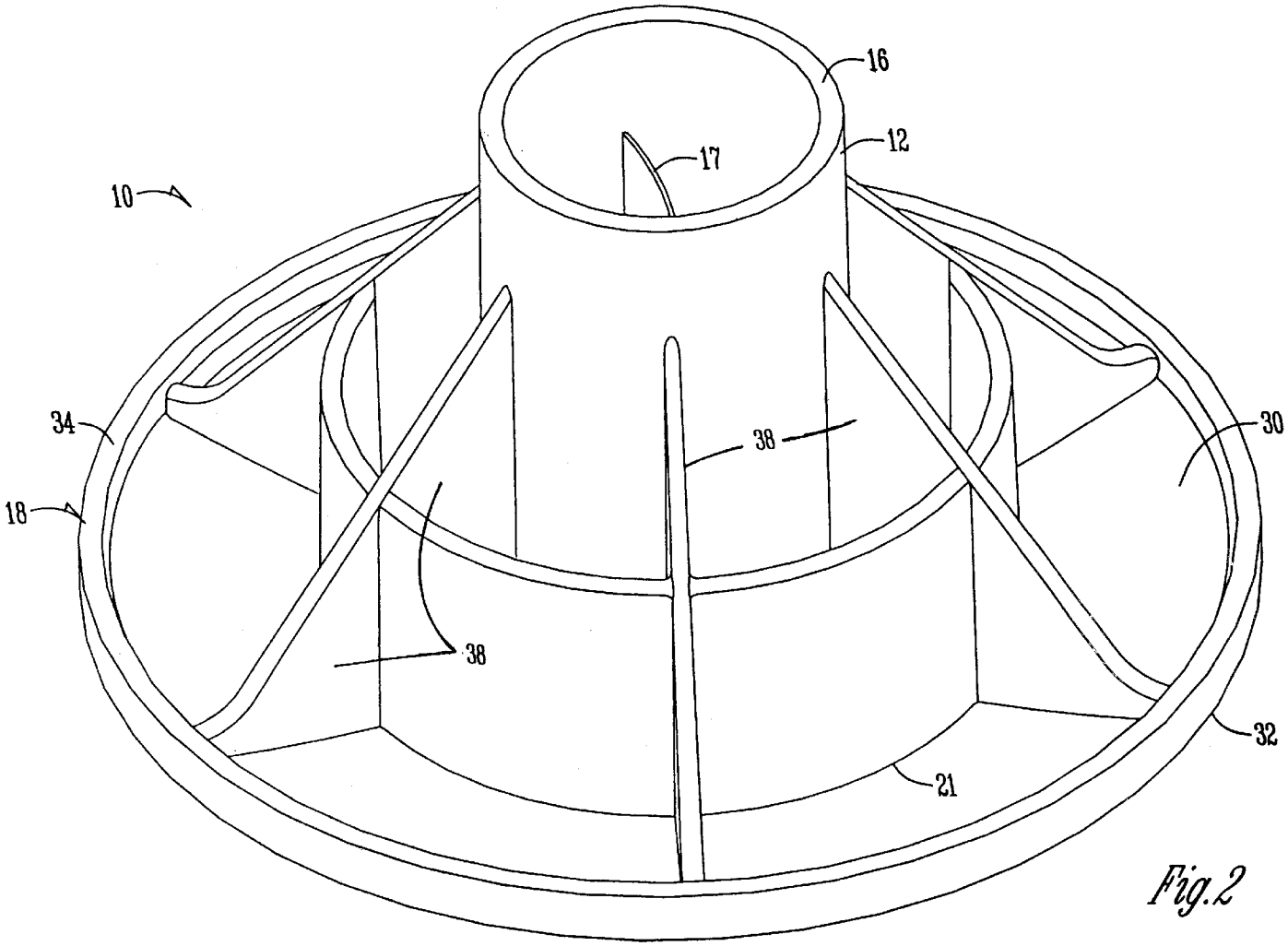
FIG. 2 is a bottom perspective view thereof.
Figure 6:
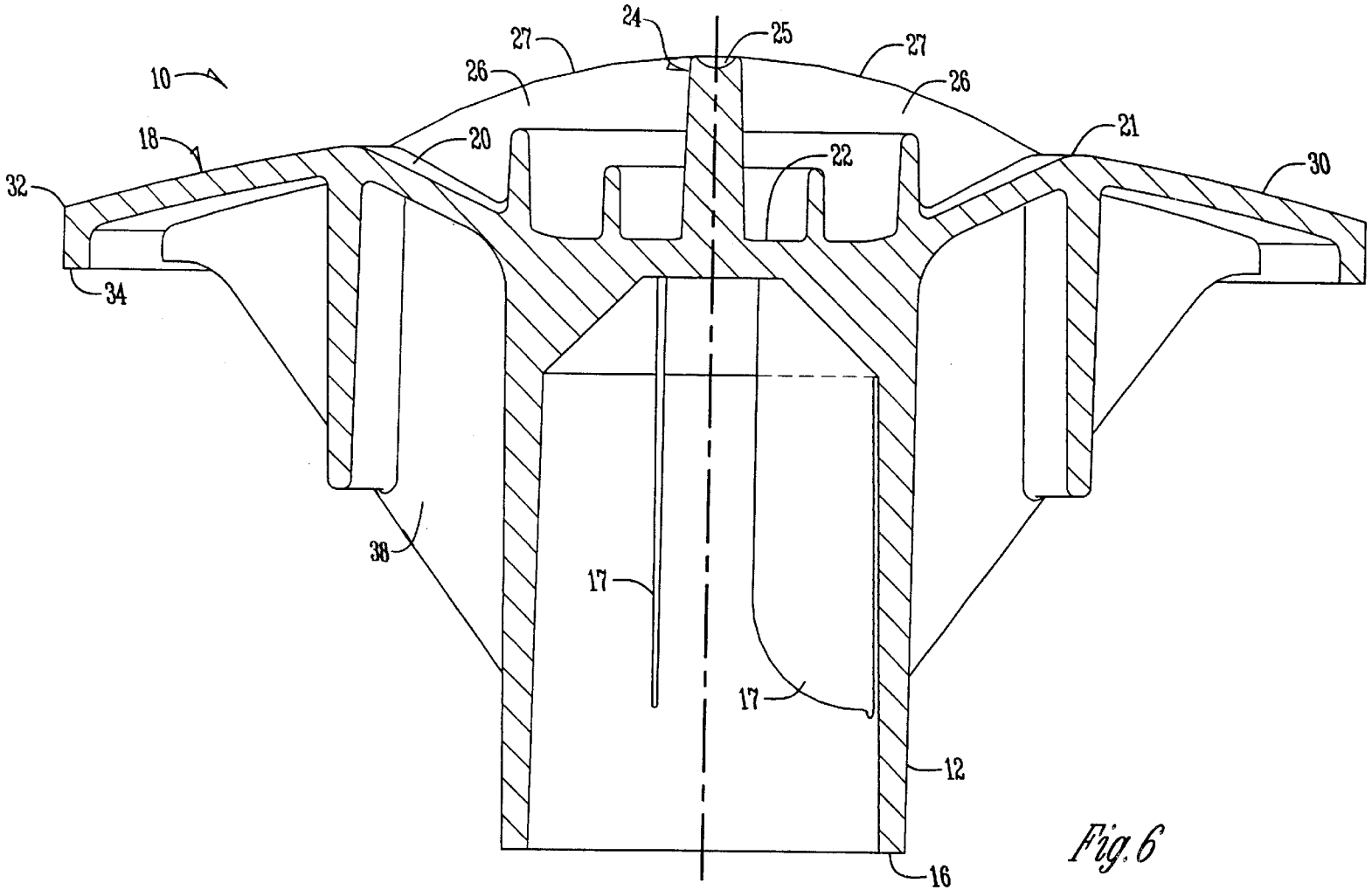
FIG. 6 is a sectional view taken on lines 6—6 of FIG. 5.

With reference to FIGS. 2 and 6, triangularly-shaped rib extensions 38 extend radially outwardly from tube 12 and dwell in the same respective planes of ribs 26. The ribs 38 extend upwardly and join the underside of canopy 30 and the circular flange 34. A circular wall 40 extends downwardly from a bottom surface of canopy 30 at a position below and opposite to the circular upper edge 21 of conically shaped wall 20. The wall 40 intersects the rib extensions 38 at the substantial mid-point of rib extensions to provide strong lateral support to the rib extensions which in turn also provide strong support for the ribs 26 and the canopy 30.

With reference to FIGS. 3 and 3A, the closed upper end 42 of tube 12 (located opposite to bottom 22 referenced above) includes flat circular center portion 44 and inverted truncated cone 46 comprised of diagonally shaped side walls 48. The walls 48 extend downwardly and outwardly from the perimeter 50 of flat center portion 44.

The numerals 52 and 54 designate the center axes of bar 36 and tube 12, respectively. The lower end 16 of the inner surface of tube 12 is tapered outwardly slightly as shown by the numeral 56 to facilitate the entry of bar 36 into tube 12.

The cover 10 is preferably comprised of a dense nylon material. The ribs 26, 28, 29 and 38 absorb the shock of a person falling thereon. The radial position of the ribs prevents them from collapsing. The canopy provides a surface area of at least 16 square inches, including the area occupied by the ribs 26 to provide an adequate area to normally prevent substantial injury to a workman falling on the cover.

Six ribs 26, are preferred and are space at 60° apart from each other. The ribs and the center post 24 gives an effective thickness of the cover 10 at point of impact of approximately ¾ inches. The secondary ribs 28 and 29 prevent the ribs 26 from spreading in an impact situation.

The ribs 26 and 38 further strengthen the cover 10 under impact and prevent the reinforcing bar from being able to tear through the cover if it should be positioned slightly off center with respect to the bar. The overall conical shape of the wall 20 helps to guide any falling object away from the rod 36 inside the tube 12.

Most importantly, the inverted truncated cone 46 helps to center the cover 10 upon installation, but even if the cover is inadvertently moved to a tilted position, the inverted truncated cone 46 will cause the cover to align itself on the reinforcing bar upon a person falling on the cover.

Additionally, by forcing the bar to the cap's center, the falling body will rotate the cap to a vertical position about a point defined by the end of the re-bar where it sits in the center of the conical section. By allowing the cap to freely tip to a vertical position, more of the cap's domed top surface is presented to the falling body to absorb impact.

It is therefore seen that this invention will accomplish at least all of its stated objectives.

What is claimed is:

1. A protective cover for covering the end of a concrete reinforcing bar, comprising, a hollow cylindrical tube having an open lower end and a closed upper end, a cap on the upper end of the tube and extending outwardly therefrom, a plurality of spaced rib elements secured to and extending radially outwardly from a centerpoint above the tube on an upper surface of the cap, the tube and the cap being comprised of a single one-piece molded plastic material of unitary construction, the closed upper end having an interior shape of an inverted truncated cone comprising a flat circular center portion of the plastic material with a diameter less than that of an interior diameter of the tube with a diagonally sloped side wall of the plastic material extending outwardly from a perimeter of the flat circular center portion and also extending in a direction towards the open end of the tube to receive the upper flat end of a reinforcing bar whereby the engagement of the upper end of the bar with the diagonally sloped walls of the plastic material will tend to center the cover on the bar.

2. A protective cover for covering the end of a concrete reinforcing bar, comprising, a hollow cylindrical rube having an open lower end and a closed upper end, a cap on the upper eni of the tube and extending outwardly therefrom, a plurality of spaced rib elements secured to and extending radially outwardly from a centerpoint above the tube on an upper surface of the cap, the tube and the cap being comprised of a single one-piece molded plastic material of unitary construction, the closed upper end having an interior shape of an inverted truncated cone comprising a flat circular center portion of the plastic material with a diameter less than that of an interior diameter of the tube with a diagonally sloped side wall of the plastic material extending outwardly from a perimeter of the flat circular center portion and also extending in a direction towards the open end of the tube whereby when the flat end of a cylindrical straight reinforcing bar having a diameter slightly less than that of the tube is inserted into the tube towards the upper end thereof, the bar will engage only the diagonally sloped side wall of the plastic material of the tube and not the flat circular center portion thereof whereupon the protective cover will be uniformly centered on the bar and the center axis of the bar and the tube will be coextensive.

3. A protective cover for covering the end of a concrete reinforcing bar, comprising, a cylindrical tube having an open lower end and an upper end, a cap on the upper end of the tube, the cap including a canopy extending outwardly from the upper end of the tube, a plurality of spaced rib elements secured to and extending radially outwardly from a centerpoint above the tube on an upper surface of the canopy, a plurality of rib extensions extending radially outwardly from the tube below the canopy and being joined with the underside of the canopy.

4. The protective cap of claim 3 wherein the rib extensions below the canopy are in the same vertical planes, respectively, as the rib elements on the upper surface of the canopy.

5. The protective cap of claim 3 wherein a circular wall is secured to and extends downwardly from the canopy and intersects the rib extensions.

6. The protective cap of claim 5 wherein the rib extensions below the canopy are in the same vertical planes, respectively, as the rib elements on the upper surface of the canopy.

7. The protective cap of claim 5 wherein the rib elements on the upper surface of the canopy have outer terminal ends located above the circular wall.

8. A protective cover for covering the end of a concrete reinforcing bar, comprising, a hollow cylindrical the having an open lower end and a closed upper end, a cap on the upper end of the tube and extending outwardly therefrom, a plurality of spaced rib elements secured to and extending radially outwardly from a centerpoint above the tube on an upper surface of the cap, the tube and the cap being comprised of a single one-piece molded plastic material of unitary construction, the closed upper end of the tube being in the form of an inverted frusto one.

9. The cover of claim 3 wherein an upper interior end of the tube terminates in the form of an inverted frusto cone.

10. The cover of claim 4 wherein an upper interior end of the tube terminates in the form of an inverted frusto cone.

11. The cover of claim 5 wherein an upper interior end of the tube terminates in the form of an inverted frusto cone.

12. The cover of claim 6 wherein an upper interior end of the tube terminates in the form of an inverted frusto cone.

13. The cover of claim 7 wherein an upper interior end of the tube terminates in the form of an inverted frusto cone.

14. The cover of claim 3 wherein a plurality of secondary ribs extend between the rib elements secured to the upper surface of the canopy.

15. The cover of claim 13, wherein a plurality of secondary ribs extend between the rib elements secured to the upper surface of the cap.

16. The cover of claim 14 wherein a plurality of secondary ribs extend between the rib elements secured to the upper surface of the cap.

* * * * *